US006187497B1

(12) United States Patent
Kushi et al.

(10) Patent No.: US 6,187,497 B1
(45) Date of Patent: Feb. 13, 2001

(54) ELETROPHOTOGRAPHIC TONER AND IMAGE FORMING METHOD

(75) Inventors: Sayuri Kushi; Tsuyoshi Uchida; Kenji Yamane, all of Hachioji (JP)

(73) Assignee: Konica Corporation (JP)

( * ) Notice: Under 35 U.S.C. 154(b), the term of this patent shall be extended for 0 days.

(21) Appl. No.: 09/567,619

(22) Filed: May 9, 2000

(30) Foreign Application Priority Data

May 14, 1999 (JP) ..... 11-134236

(51) Int. Cl.[7] ..... G03G 9/08
(52) U.S. Cl. ..... 430/110; 430/111; 430/120
(58) Field of Search ..... 430/110, 111, 430/120

(56) References Cited

U.S. PATENT DOCUMENTS 5,296,324 * 3/1994 Akagi et al. ..... 430/111
5,437,954 * 8/1995 Saito ..... 430/110
5,470,687 * 11/1995 Mayama et al. ..... 430/111
5,480,755 * 1/1996 Uchiyama et al. ..... 430/110
5,776,646 * 7/1998 Hagi et al. ..... 430/110
5,827,632 * 10/1998 Inaba et al. ..... 430/111
5,981,132 * 11/1999 Kurose et al. ..... 430/110
6,001,527 * 12/1999 Ishihara et al. ..... 430/120
6,103,441 * 8/2000 Tomita et al. ..... 430/111

* cited by examiner

*Primary Examiner*—Roland Martin
(74) *Attorney, Agent, or Firm*—Jordan B. Bierman; Bierman, Muserlian and Lucas

(57) ABSTRACT

An electrophotographic toner comprising colored particles comprised of inorganic particles is disclosed.

The inorganic particles have a saturated moisture content $W_L$ at ambient conditions of 10° C. and 20 percent RH of 1.0 to 2.0 percent by weight, a BET value of 70 to 120 $m^2/g$, and a number average primary particle diameter of 10 to 50 nm. Further, the volume average particle diameter of said electrophotographic toner is between 3.0 and 9.0 $\mu$m.

17 Claims, 3 Drawing Sheets

ELETROPHOTOGRAPHIC TONER AND IMAGE FORMING METHOD

FIELD OF THE INVENTION

The present invention relates to an electrophotographic toner, and specifically to an electrophotographic toner comprising an external additive and an image forming method using the same.

BACKGROUND OF THE INVENTION

As an image forming method employing an electrophotographic toner (hereinafter occasionally referred to as toner), heretofore, from the viewpoint of simplicity as well as convenience, a dry development system, which uses a magnetic brush and the like, has been employed. In said development system, an electrostatic latent image is formed on the surface of a photoreceptor and said electrostatic latent image is subjected to toner development, employing a magnetic brush and the like. The resulting toner image is then transferred onto a transfer material employing means such as electrostatic transfer and the like, and finally the toner is fixed onto the transfer material, employing common means such as a heated roll and the like to form long lasting images. Any toner, which is not transferred and remains on the photoreceptor, is removed as waste toner, employing conventional means such as a cleaning blade and the like.

In recent years, image forming methods, which utilize an electrophotographic system, have been widely employed as a hard copy output system, especially for printers, and the like.

In such a system, in order to obtain high image quality, a decrease in the diameter of toner particles is demanded. As the diameter of toner particles decreases, the surface area of the toner increases. Thus, moisture adsorption and the like increases, and variation of chargeability increases in response to variations of ambient conditions in which said toner is employed. As a result, it is difficult to consistently form images.

Further, it is known that an electrophotographic toner is provided with chargeability as well as fluidity by adding external additives such as fine inorganic particles, and the like, to colored particles. As such fine inorganic particles, for example, Japanese Patent Publication Open to Public Inspection Nos. 59-52255, 62-129861, 6-11886, 6-75430, 7-230179, as well as others, describe various items on hydrophobic titanium dioxide which minimizes the influence of ambient conditions under which the toner is employed.

However, when toner particles having a small diameter are employed for an extended period of time, fine inorganic particles are occasionally buried in the surface of colored particles. Therefore, at present, it is impossible to consistently maintain the desired effects of such fine inorganic particles.

Further, recently, from the viewpoint of minimizing waste, a recycling system, in which waste toner collected by a cleaning means is reused for subsequent development, has received great attention. When said waste toner is reused through recycling, a mechanism, in which said toner is recovered and conveyed from the cleaning section to the development section, is specifically provided. During conveyance and the like, the toner is subjected to stress. As a result, the fine inorganic particles tend to be buried in colored particles. The surface state of toner, comprising the colored particles into which fine inorganic particles are buried, is greatly affected by the fine inorganic particles. As a result, the amount of adsorbed moisture largely varies depending on the variations of the ambient conditions. Thus, when the ambient conditions, under which the toner is employed, vary, the variation of chargeability is exaggerated, and the problem of variation of image density as well as background stain occurs.

Due to that, desired is a toner which is not subjected to variation of ambient conditions, but can maintain consistent image quality for an extended period of time.

SUMMARY OF THE INVENTION

It is an object of the present invention to provide a toner which is not affected by the temperature as well as the humidity of ambient conditions, in which said toner is employed, and does not cause problems such as a decrease in image density, background stain formation, and the like, when employed for an extended period of time, and an image forming method using the same.

The present invention and the embodiments thereof will be described.

The electrophotographic toner of the present invention comprises colored particles comprised of at least resins as well as colorants and fine inorganic particles, and said fine inorganic particles have a saturated moisture content WL at ambient conditions of 10° C. and 20 percent RH of 1.0 to 2.0 percent by weight, a BET value of 70 to 120 $m^2/g$, and a number average primary particle diameter of 10 to 50 nm. Further, the volume average particle diameter of said electrophotographic toner is between 3.0 and 9.0 $\mu$m.

Fine inorganic particles preferably have the following relationship between the saturated moisture content $W_H$ at ambient conditions of 30° C. and 80 percent RH and the saturated moisture content $W_L$ at ambient conditions of 10° C. and 20 percent RH:

$$0 \leqq (W_H - W_L)/W_L \times 100 \leqq 15.0$$

An image forming method is preferably employed in which the surface of an electrophotographic photoreceptor is charged; an electrostatic latent image is formed by image-wise exposure; an obtained electrostatic latent image is subjected to magnetic brush development employing an electrophotographic toner; said toner image is transferred onto a transfer material and fixed; and image formation is carried out on many sheets by repeating a process in which any residual toner on said electrophotographic photoreceptor is removed.

DETAILED DESCRIPTION OF THE INVENTION

Figure 1:
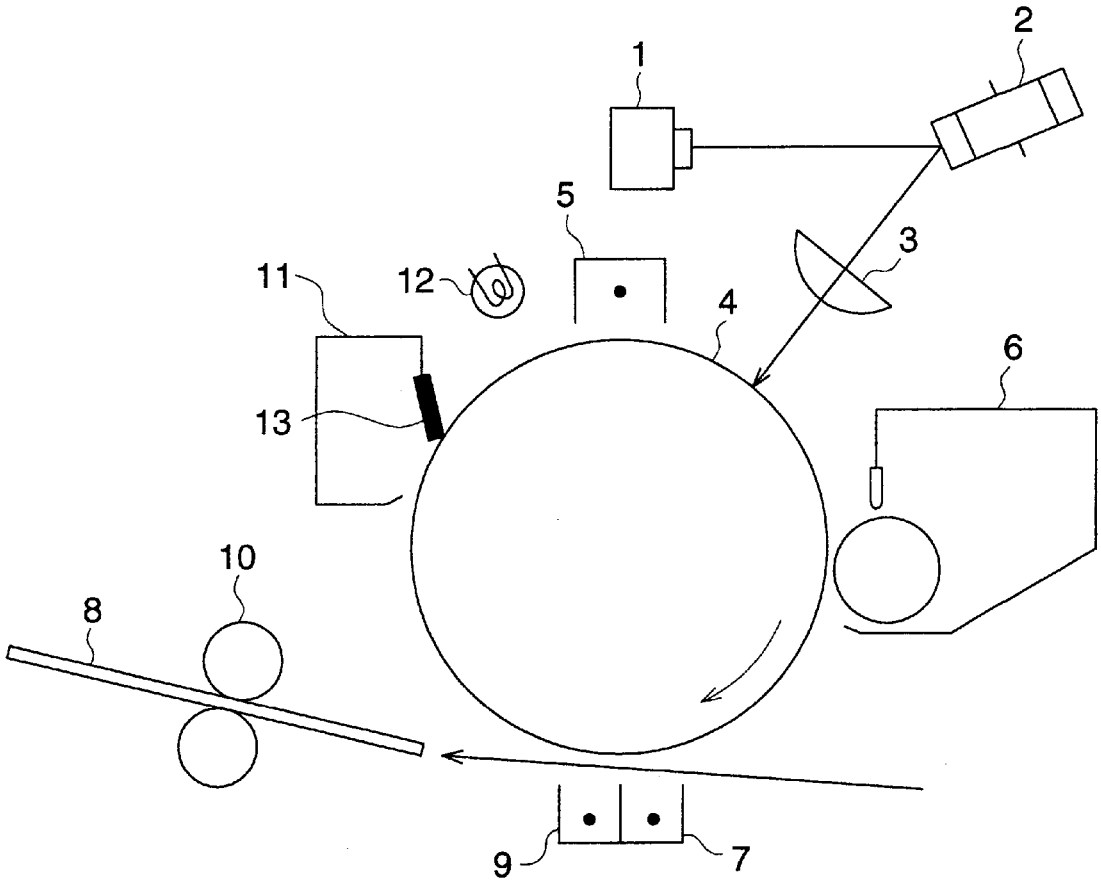
FIG. 1 is a cross-sectional structural view showing one example of the image forming apparatus of the present invention.

In order to overcome the aforementioned problems, the inventors of the present invention have paid much close attention to the characteristics of fine inorganic particles employed as an external additive.

The present inventors have investigated factors which are subject to ambient variations and have found that fine inorganic particles on the surface of colored particles play a significant role. The fine inorganic particles on the surface of colored particles are subjected to mechanical stress such as agitation while in the interior of the development device, during conveyance, and the like for an extend period of time, and are buried from the surface of the colored particles in interior of said particles. As a result, it has been discovered that the surface state of the colored particles is greatly influenced by the fine inorganic particles, and even though colored particles themselves are comprised of hydrophobic materials, the fine inorganic particles adsorb moisture; the total moisture content adsorbed by the toner varies; and as a result, the chargeability of the toner itself greatly varies depending on the ambient conditions.

Specifically, in such a toner comprised of small particles with a diameter of about 3.0 to 9.0 $\mu$m as employed in the present invention, it is assumed that since the surface area is greater, effects due to ambient conditions are large.

In order to solve this problem, it was learned that it is important to minimize the variation of moisture content in the fine particles due to ambient conditions.

The toner of the present invention is obtained by mixing while stirring, the colored particles described below with fine hydrophobic inorganic particles which have been subjected to hydrophobic treatment and other additives, if desired, employing a mixer, such as a Henschel mixer. <Fine Inorganic Particles>

Fine inorganic particles, which are employed in the toner of the present invention as additives (hereinafter referred to as the fine inorganic particles of the present invention), have a number average primary particle diameter of 10 to 50 nm, a saturated moisture content $W_L$ of 1.0 to 2.0 percent by weight, and a BET value of 70 to 120 $m^2/g$.

When t he number average primary particle diameter is less than 10 nm, fine inorganic particles of the present invention are subjected to mechanical stress during use over an extended period of time and tend to be buried in the toner. As a result, it is difficult to maintain the desired effects of the present invention. on the other hand, when the number average primary particle diameter is at least 50 nm, adhesion of said fine inorganic particles to the toner decreases and inorganic particles tend to be are desorbed. As a result, it is difficult to maintain the desired effects. Further, said fine inorganic particles adhere onto the photoreceptor and problems, such as so-called black spots and the like, tend to occur. Further, since the hiding ratio is lower, in order to compensate for the shortage of the covering ratio onto colored particles, it is necessary to increase the added amount of external additives. As a result, said additives tend to be released and cleaning problems such as streak defects and the like, due to a residual toner, tend to occur.

When the saturated moisture content of the fine inorganic particles at ambient conditions of 10° C. and 20 percent RH is less than 1.0 percent by weight, the moisture content in the fine inorganic particles on the surface of a toner is relatively small, and likewise the amount of leaked charge is also relatively small. As a result, the charge amount of the toner increases as the toner is used, and the amount of over-charged toner increases. Thus, problems occur in which image density decreases and background staining occurs. Incidentally, it is assumed that said background stain is formed by the generation of toner having an opposite polarity due to mutual friction of the over-charged toner with the normal toner. Further, when the saturated moisture content $W_L$ exceeds 2.0 percent by weight, the moisture content of the toner surface becomes excessive. As a result, charge leak from the charged toner occurs, and a problem tends to occur in which background stain is formed due to a decrease in the absolute value of the charged amount.

When the BET value of the fine inorganic particles of the present invention is less than 70 $m^2/g$, due to the smooth surface of t he particles, it is impossible t o secure sufficient moisture amount in the fine inorganic particles at ambient conditions of low temperature as well as low humidity. On the other hand, when the BET value of the same exceeds 120 $m^2/g$, minute unevenness is excessively formed on the surface, and a large amount of moisture, and the like, are adsorbed. As a result, leak of the toner charge tends to occur, making it impossible to exhibit the desired effects of the present invention.

The following relationship is preferably held between the saturated moisture content $W_H$ of the fine organic particles at ambient conditions of 30° C. and 80 percent RH and the saturated moisture content $H_L$ of the fine inorganic particles at ambient conditions of 10° C. and 20 percent RH:

$$0 \leqq (W_H - W_L)/W_L \times 100 \leqq 15.0$$

When this relationship is maintained, at ambient conditions of high temperature as well as high humidity, moisture is appropriately adsorbed. As a result, the difference in charge leak is reduced at ambient conditions of high temperature as well as high humidity, and thus it is possible to maintain the desired stability in spite of adverse ambient conditions.

The saturated moisture content on the surface of fine inorganic particles can be controlled by manipulating the surface properties of said fine inorganic particles. Namely, since the surface of fine inorganic articles themselves is hydrophilic, the adsorbed moisture amount increases. On the other hand, by carrying out hydrophobic treatment, the surface becomes hydrophobic and the amount of adsorbed moisture decreases. Specifically, it is possible to control the saturated moisture content Of $W_L/W_H$ by controlling the added amount of a hydrophobic treatment agent in response to the surface properties of the fine inorganic particles.

$W_L$ is more preferably between 1.2 and 1.9 percent by weight.

$\{(W_H - W_L)/W_L\} \times 100$ is more preferably between 7.0 and 15.0.

Employed as fine inorganic particles may be various types of inorganic oxides such as nitrides, borides, and the like. Listed as examples are titanium oxide, alumina, zirconia, barium titanate, aluminum titanate, strontium titanate, magnesium titanate, zinc oxide, chromium oxide, cerium oxide, antimony oxide, tungsten oxide, tin oxide, manganese oxide, boron oxide, silicon carbide, boron carbide, titanium carbide, silicon nitride, titanium carbide, silicon nitride, titanium nitride, boron nitride, and the like. These fine inorganic particles are subjected to hydrophobic treatment. The hydrophobic treatment is preferably carried out employing various types of coupling agents such as titanium coupling agents, silan coupling agents, and the like, and silicone oil, and the like. The hydrophobic treatment is also preferably carried out employing higher fatty acid metal salts such as aluminum stearate, zinc stearate, calcium stearate, and the like. Among them titanium oxide is preferable since the advantage of the present invention can be obtained than others even though more severe condition such as high temperature, high humidity and repeating use for long period of time.

The representative example of the fin e inorganic particles employed in the present invention is titanium oxide. Employing titanium oxide as an example, the present invention will be described in more detail. Said titanium oxide employed in the present invention may be prepared employing a wet method. Listed as wet methods are a sulfuric acid method and a hydrochloric acid method. Described as an example of the production of titanium oxide employing the wet method is the sulfuric acid method.

Raw materials such as ilmenite ore, and the like, are dissolved in sulfuric acid, and impurities are removed employing sedimentation and the like. The resulting solution is hydrolyzed and is mixed with a titanium oxide seed particle dispersion in which said seed particles function as nuclei. Thus by growing crystals, particles are allowed to grow. After drying, the resulting particles are sintered at a high temperature. The sintered product is crushed to obtain hydrophilic titanium oxide which is employed as a raw material for titanium oxide of the present invention. Adjustment of the BET value and the like may be carried out by controlling the sintering temperature. The number average primary particle diameter may be adjusted by controlling the concentration of seed particles in said dispersion during growth of the particles, after hydrolysis.

Fine inorganic particles may be provided with hydrophobicity employing the hydrophobic treatment described below. The degree of hydrophobicity, when measured employing the methanol wettability method described below, is at least 40 and, is preferably between 50 and 90.

Examples of preferred agents, which provide hydrophobicity, include so-called coupling agents such as various types of titanium coupling agents, silan coupling agents, and the like, silicone oil, and the like. Further, higher fatty acid metal salts, such as aluminum stearate, zinc stearate, calcium stearate and the like, are also included.

Hydrophobicity providing agents as well as processing methods to carry out the hydrophobic treatment for fine inorganic particles will now be described.

Listed as hydrophobicity providing agents are, for instance, titanium coupling agents such as tetrabutyl titanate, tetraoctyl titanate, isopropylisostearoyl titanate, isopropyltridecylbenzenesulfonyl titanate, bis(dioctylpyrophosphate) oxyacetate titanate, and the like. Listed as silane coupling agents are γ-(2-aminoethyl)aminopropyltrimethoxysilane, γ-(2-aminoethyl)aminopropylmethyldimethoxysilane, γ-methacryloxypropylmethoxysilane, N-β-(N-vinylbenzylaminoethyl)γ-aminopropyltrimehtoxysilane hydrochloric acid salt, hexamethyldisilazane, methyltrimethoxysilane, butyltrimethoxysilane, isobutyltrimethoxysilane, hexyltriethoxysilane, hexyltrimethoxysilane, octyltrimethoxysilane, decyltrimethoxysilane, dodecytrimethoxysilane, phenyltrimethoxysilane, o-methylphenyltrimethoxysilane, p-methylphenyltrimethoxysilane, and the like.

Cited as fatty acids and metal salts thereof are long chain fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linoleic acid, arachidonic acid, and the like, and salts thereof, as well as with metals such as zinc, iron, magnesium, aluminum, calcium, sodium, lithium and the like.

Listed as silicone oil is dimethyl silicone oil, methylphenyl silicone oil, amino-modified silicone oil, and the like.

Such compounds are added to fine inorganic particles which become components in an amount of 5 to 40 percent by weight, and preferably in an amount of 10 to 35 percent by weight, and preferably cover the entire surface of said particles. These materials may be employed in combination. It is also possible to carry out surface treatment employing polysiloxane, having an ammonium salt as a functional group.

Fine inorganic particles are added to colored particles in an amount of 0.1 to 10 percent by weight, and preferably in an amount of 0.5 to 5.0 percent by weight. When the added amount is excessively small, the effects of the present invention are barely exhibited. On the other hand, when the added amount is excessively large, the fine inorganic particles tend to be released, and problems of abrasion on the photoreceptor and the like, tend to occur.

The moisture content in the fine inorganic particles is measured by a Karl Fischer Method measurement apparatus "AQS-724" (manufactured by Hiranuma Sangyo Co., Ltd.). At such time, special caution should be paid during sampling and said sampling is preferably carried out as follows:

Fine inorganic particles are placed in a bottle with a threaded cap under each of specified ambient conditions, that is, 30° C. and 80 percent RH, and 10° C. and 20 percent RH, and the bottle is sealed. If the bottle is not sealed in the selected ambient conditions and taken from said conditions to the outside, the moisture in the fine inorganic particles will reach is equilibrium with the outside in a very short time. As a result, it is difficult to obtain correct moisture content due to variation of the ambient conditions under which the sample is captured by the bottle. In the measurement of the moisture content in the fine inorganic particles, the effects of physical adsorption exhibiting a weak bonding force is also important. Therefore, the measurement should be carried out with the utmost care. As a comparison, ambient air is also sampled and evaluated.

The degree of hydrophobicity of fine inorganic particles is specified employing a methanol wettability test. The measurement method of the methanol wettability test and the method to calculate the degree of hydrophobicity are as follows:

Added to 50 ml of distilled water placed in a beaker having an inner volume capacity of 250 ml is 0.2 g of a sample to be measured. Subsequently, from a burette of which tip is immersed into said distilled water to which said sample is placed, methanol is allowed to slowly drip into said distilled water under gentle stirring until the entire sample becomes wet. The degree of hydrophobicity can be calculated employing the formula described below:

Degree of hydrophobicity=$\{a/(a+50)\}\times 100$ (in %) wherein a is the volume (in ml) of methanol which is necessary for perfectly wetting the sample.

The BET specific area of fine inorganic particles was measured using a "Flowsorb 2300" (manufactured by Shimadzu Seisakusho Co., Ltd.), employing the one point method of a nitrogen adsorption method.

The number average primary particle diameter of fine inorganic particles is obtained as follows. A photograph of said fine inorganic particles is taken employing a transmission type electron microscope at a magnification factor of 100,000. One hundred particles in the resulting photograph are observed, and the number average primary particle diameter is expressed as an arithmetic mean measured by the image analysis.

The preferred representative example of fine inorganic particles is titanium oxide. When said titanium oxide is employed, it is possible to employ other fine inorganic particles having a number average primary particle diameter of 10 to 1,000 nm together with said titanium oxide. Employed as fine inorganic particles may be various types of inorganic oxides, nitrides, borides, and the like. For instance, listed may be silica, alumina, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, boron nitride, and the like. Further, employed also may be fine inorganic particles, which are subjected to hydrophobic treatment. Said hydrophobic treatment is preferably carried out employing so-called coupling agents such as various types of titanium coupling agents, silane coupling agents, and the like, as well as silicone oil. Said hydrophobic treatment is preferably carried out employing higher fatty acid metal salts such as aluminum stearate, zinc stearate, calcium stearate, and the like.

Further, it is possible to employ fine organic particles as well as fine composite particles, which are prepared by adhering fine inorganic particles onto the surface of fine organic particles.

Further, it is possible to employ lubricants such as long chain fatty acid metal salts, such as aluminum stearate, zinc stearate, calcium stearate, and the like.

These materials may preferably be added to colored particles in an amount of 0.1 to 10.0 percent by weight.

<Colored Particles>

Colored particles constituting the toner of the present invention are obtained from the following: binder resins, colorants, releasing agents, and if desired, charge control agents and magnetic materials are subjected to dry-type blending, and thereafter, the resulting mixture is kneaded and mixed employing a kneader, an extruder, and the like.

<<Binder Resins>>

Listed as the aforementioned binder resins, are for example, polyester resins, styrene-acrylic acid alkyl based resins, styrene-methacrylic acid alkyl based resins, styrene-butadiene based resins, styrene-acrylonitrile resins, styrene-acryl-polyester resins, styrene-acryl-crystalline polyester graft resins, polyurethane resins, epoxy resins, silicone resins, polyvinyl chloride, polyamide, polyvinyl butyral, rosin, modified rosin, phenol resins, xylene resins, and the like.

<<Colorants (Magnetic Materials)>>

Listed as the aforementioned colorants are, for instance, carbon black, Chrome Yellow, du Pont Oil Red, Quinoline Yellow, Phthalocyanine Blue, and magnetic materials. The magnetic materials include metals such as iron, cobalt, nickel and the like which exhibit ferromagnetism, and alloys thereof, and compounds comprising these elements.

<<Releasing Agents>>

Listed as the aforementioned releasing agents, are olefin compounds such as polypropylene and polyethylene, and modified compounds thereof, and paraffin waxes such as carnauba wax, fatty acid amidowax, sasol wax and the like.

<<Charge Control Agents>>

Furthermore, if desired, the colored particles constituting the toner of the present invention may comprise charge control agents. Listed as charge control agents are positively chargeable charge control agents such as quaternary ammonium salt metal complexes, triphenylmethane, and the like, and negatively chargeable charge control agents such as monoazo light-metal complexes, salicylic acid metal complexes, and the like.

[Composition of Developer Material]

The toner of the present invention may be employed in all of a double component developer material, a single component non-magnetic developer material, or a one-component magnetic developer material. Of these, said toner is most suitably employed in the double component developer material. When said toner is employed in the two-component developer material, employed as a carrier may be a coated carrier which is prepared by applying styrene-acrylic resins, fluorine-modified acrylic resins, and silicone resins onto the surface of iron powder, ferrite cores, and magnetite cores.

[Image Forming Method]

The image forming method of the present invention is described with reference to FIG. 1.

FIG. 1 is a cross-sectional view showing one example of the image forming apparatus of the present invention. Reference numeral 4 is a photoreceptor drum, which is prepared by forming an organic photosensitive layer (OPC) on the circumferential surface of an aluminum drum base body which rotates in the arrowed direction at a specified rate.

In FIG. 1, based on information which is read by an original document reading device (not shown), exposure light is emitted from semiconductor laser beam source 1. The emitted light is bent to be perpendicular to the sheet of paper in FIG. 1, employing-polygonal mirror 2, and is irradiated onto the surface of said photoreceptor through fθ lens 3, which corrects image distortion to form an electrostatic latent image. Photoreceptor drum 4 has been previously uniformly charged and started to rotate clockwise synchronized with the image exposure timing.

The electrostatic latent image on the surface of the photoreceptor drum 4 is developed by development unit 6, and a formed toner image is transferred onto transfer material 8 conveyed, synchronized with the timing of transfer unit 7. Further, transfer material 8 is separated from the photoreceptor drum 4 by separation unit 9. The transferred toner image is borne by transfer material 8, led to fixing unit 10, and subsequently fixed.

The residual toner on the photoreceptor surface, which has not been transferred, is removed by cleaning unit 11 utilizing a cleaning blade system, and the residual charge on the photoreceptor surface is eliminated by pre-charging light exposure (PCL) 12. Subsequently, the photoreceptor surface is uniformly recharged for the following image formation by the charging unit 5 again.

In an image forming method, it is preferable that from the viewpoint of cost reduction as well as to minimize environmental pollutants, specifically, a toner recycling system is employed. Listed as methods to carry out toner recycling, may be, for example, a method in which residual toner, recovered in a cleaning section, is then conveyed to a hopper for supply toner or development unit or mixed with supply toner in an intermediate chamber and supplied to the development unit, and the like. The preferred methods include the method in which the recovered toner is directly returned to the development unit or a method in which fresh toner and the recycled toner are mixed in an intermediate chamber and supplied to the development unit.

Figure 2:
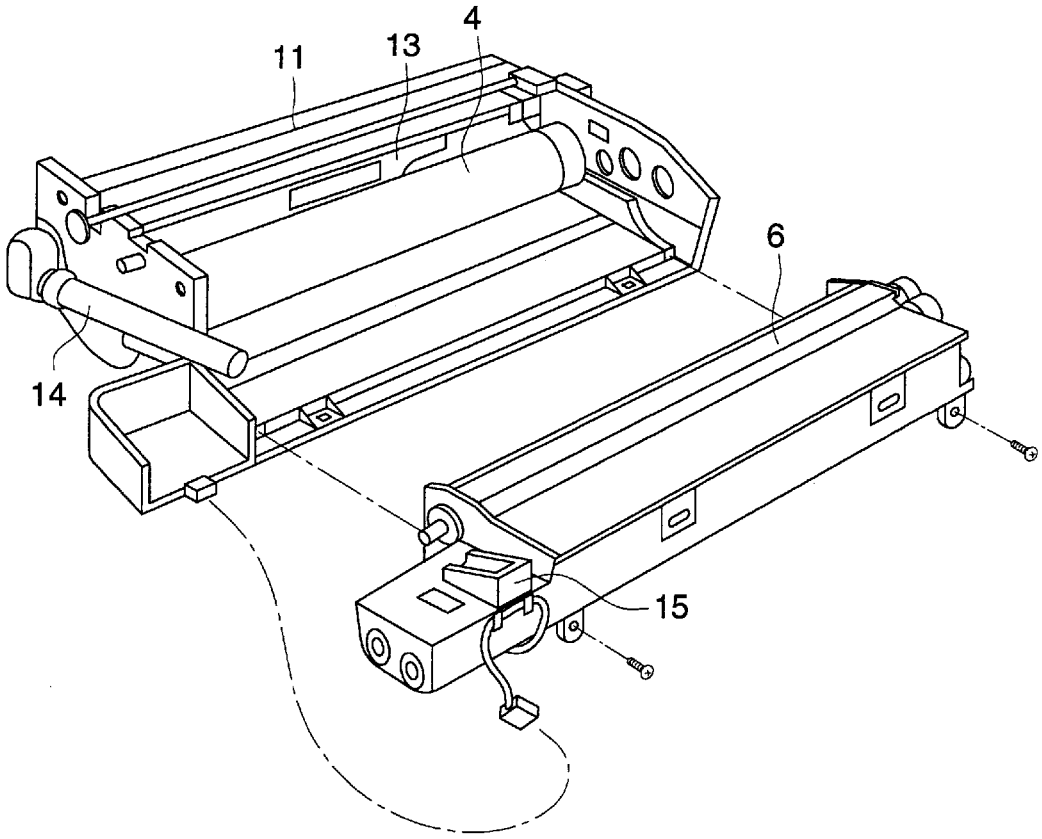
FIG. 2 is a perspective structural view of a toner recycling member.

FIG. 2 is a perspective view of a toner recycling apparatus. FIG. 2 shows a system in which a recycled toner is directly returned to the development unit.

Waste toner recovered by cleaning blade member 13 is collected by toner recycling tube 14, employing a toner conveying screw (not shown) in toner cleaning unit 11; is returned to the development unit 6 from receiving receptacle 15 of the toner recycling tube; and is again employed as a developer material.

FIG. 2 also is a perspective view of a processing cartridge which is detachable from the image forming apparatus of the present invention. In said FIG. 2, in order to clarify the perspective structure, the photoreceptor unit and the developer material unit are shown separately. These units are integrally fabricated, but the fabricated unit can be detached from and mounted onto the image forming apparatus. In this case, the photoreceptor drum 4, the development unit 6, the cleaning unit 11, and the recycling member are integrally fabricated so as to serve as a processing cartridge.

The image forming apparatus may be structured in such a manner that a processing cartridge comprised of at least one of the photoreceptor drum 4, the development unit 6, the cleaning unit 11, the toner recycling pipe 14 and the receiving receptacle being installed thereon.

Transfer material 8 is commonly plain paper. However, it is not particularly limited as long as unfixed images after development are transferable. Accordingly, said transfer material 8 includes PET base for overhead projectors and the like.

Figure 3:
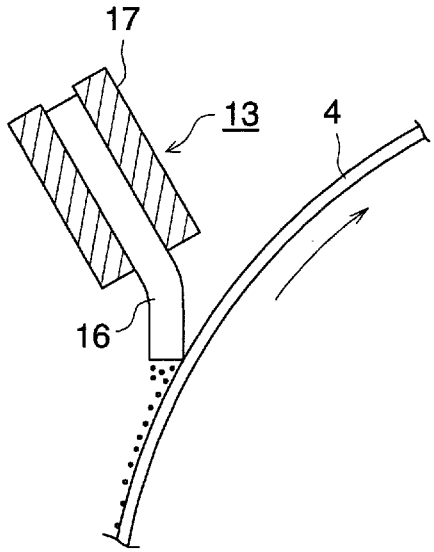
FIG. 3 is a structural view showing a cleaning member in contact with a photoreceptor drum.
Figure 4:
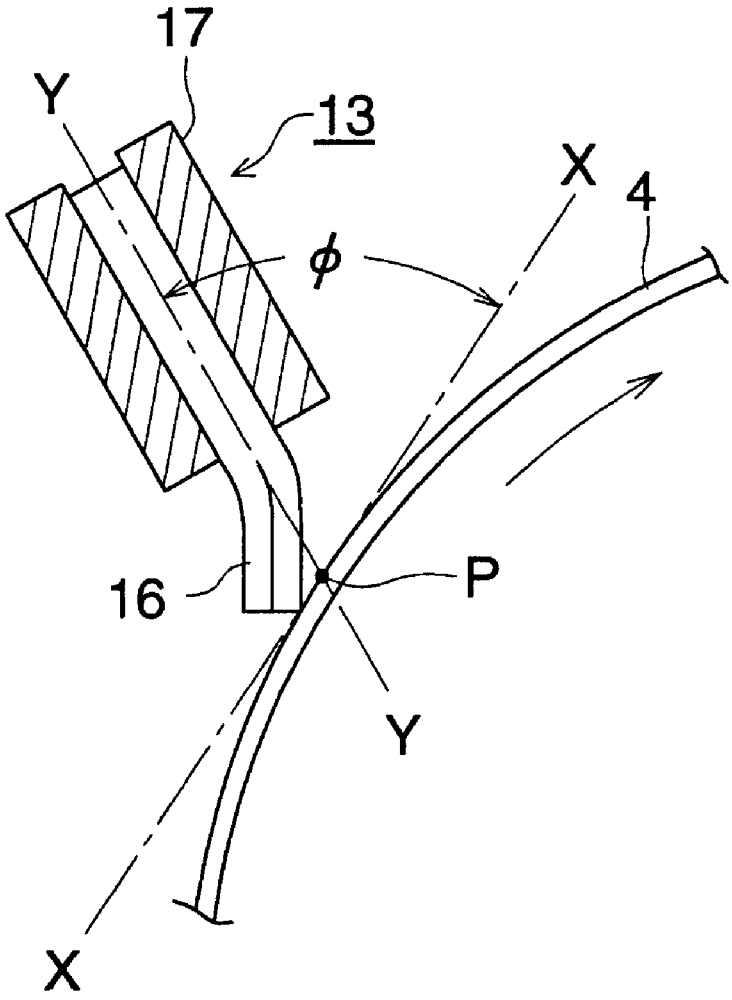
FIG. 4 is a structural view of a cleaning member in contact with a photoreceptor drum at contact angle $\phi$.

FIG. 3 is a structural view of a cleaning member in contact with photoreceptor drum 4. FIG. 4 is another structural view of a cleaning member in contact with photoreceptor drum 4 at contact angle $\phi$. In FIGS. 3 and 4, as cleaning member 13, elastic blade 16 having a thickness of 1 to 30 mm, comprised of a rubber-like elastic body, is employed, and urethane rubber is most preferably employed. The cleaning blade member 13 is structured in such a manner that the edge of the elastic blade 16, of which base part is held by holder 17, and brought into contact with the photoreceptor drum. Contact angle $\phi$ of the holder 17 of said elastic blade 16 to the photoreceptor drum is preferably set at less than 90°. A contact angle $\phi$ of less than 90°, as described herein, means that when line (Y—Y) is extended parallel to the holder 17 holding the elastic blade 16, and tangential line (X—X) is drawn on the surface of said photoreceptor drum at the place where the extension line comes into contact with the surface of said photoreceptor, the angle of the resulting tangential line (X—X) to extension line (Y—Y) is less than 90°.

To obtain sufficient cleaning capability at said angle of at least 90°, a given force, which crushes said toner, is applied. As a result, the toner is subjected to great stress and external additives tend to be buried in the surface of the toner. The lower limit of said angle is not definitely determined. However, from the viewpoint of cleaning force, it is preferably at least 15°.

Employed as materials for the elastic blade 16 employed in the present invention may be urethane rubber, silicone rubber, fluorine rubber, chloroprene rubber, butadiene rubber, and the like. Of these, urethane rubber based materials are particularly preferred. Further, urethane rubber is specifically preferred, which is obtained by allowing polycaprolactone ester, comprising a caprolactone ester with an average molecular weight of 1,000 to 4,000 in an amount of at least 30 percent by weight, to react with polyisocyanate, and subsequently being hardened, as described in Japanese Patent Publication Open to Public Inspection No. 59-30574.

When an elastic blade is employed, pushing pressure is preferably between 15 and 25 g/cm. Regarding its physical properties, hardness, tensile strength, and impact resilience measured by JIS K 6301 are preferably between 60 and 90°, at least 250 kg/cm$^2$, and at least 20 kg/cm$^2$, respectively.

EXAMPLES

The present invention will specifically be described with reference to the examples below. In the following description, "parts" and "%" express "weight parts" and "% by weight", respectively, unless otherwise specified.

<Colored Particle Production Example 1>

In accordance with common conditions, colored particle compositions for toners described below were kneaded, pulverized, and classified to adjust the volume average diameter to various values, and Colored Particles 1 through 7, shown in Table 1, were obtained.

Binder resin: styrene-acrylic resin (100 parts)
Colorant: carbon black (10 parts)
Releasing agent: propylene wax (5 parts)
Charge control agent: negatively chargeable charge control agent (azo based metal complex) (2 parts)

TABLE 1

| Colored Particle No. | Volume Average Particle Diameter |
|---|---|
| Colored Particle 1 | 2.6 μm |
| Colored Particle 2 | 4.3 μm |
| Colored Particle 3 | 5.8 μm |
| Colored Particle 4 | 6.3 μm |
| Colored Particle 5 | 7.5 μm |
| Colored Particle 6 | 8.5 μm |
| Colored Particle 7 | 9.2 μm |

<Colored Particle Production Example 2>

In accordance with common conditions, colored particle compositions for toners described below were kneaded, pulverized, and classified to adjust the volume average diameter to various values, and Colored Particles 8 though 14, shown in Table 2, were obtained.

Binder resin: styrene-acrylic resin (100 parts)
Colorant: magnetic powder (spherical magnetite) (50 parts)
Releasing agent: propylene wax (5 parts)
Charge control agent: negatively chargeable charge control agent (azo based metal complex)(2 parts)

TABLE 2

| Colored Particle No. | Volume Average Particle Diameter |
|---|---|
| Colored Particle 8 | 2.6 μm |
| Colored Particle 9 | 4.3 μm |
| Colored Particle 10 | 5.8 μm |
| Colored Particle 11 | 6.3 μm |
| Colored Particle 12 | 7.5 μm |
| Colored Particle 13 | 8.5 μm |
| Colored Particle 14 | 9.2 μm |

<<Preparation of Hydrophobic Titanium Oxide>>

After hydrolyzing titanium oxide obtained by a wet method, the concentration as well as the sintering temperature of seed particles to be added was variously adjusted, and further, types of hydrophobicity providing agents for the surface as well as the added amount to titanium oxide was adjusted. Thus Hydrophobic Titanium Oxides 1 through 10 of characteristics shown in Table 3 were obtained.

TABLE 3

| Fine Inorganic Particles | Number Average Primary Particle Diameter (in nm) | BET Value (m$^2$/g) | $W_L$ (in % by weight) | $(W_H-W_L)/W_L \times 100$ | Hydrophobicity (in %) | Hydrophobicity Providing Agent (type/amount) |
|---|---|---|---|---|---|---|
| Titanium Oxide 1 | 12 | 115 | 1.9 | 12.6 | 55 | A/15 wt % |
| Titanium Oxide 2 | 20 | 103 | 1.6 | 9.6 | 60 | A/25 wt % |
| Titanium Oxide 3 | 32 | 78 | 1.4 | 13.3 | 62 | C/25 wt % |

TABLE 3-continued

| Fine Inorganic Particles | Number Average Primary Particle Diameter (in nm) | BET Value ($m^2/g$) | $W_L$ (in % by weight) | $(W_H-W_L)/W_L \times 100$ | Hydrophobicity (in %) | Hydrophobicity Providing Agent (type/amount) |
|---|---|---|---|---|---|---|
| Titanium Oxide 4 | 46 | 82 | 1.5 | 12.2 | 58 | C/15 wt % |
| Titanium Oxide 5 | 55 | 79 | 1.6 | 11.2 | 55 | C/10 wt % |
| Titanium Oxide 6 | 20 | 103 | 1.6 | 9.3 | 60 | B/15 wt % |
| Titanium Oxide 7 | 20 | 103 | 1.6 | 9.6 | 62 | B/25 wt % |
| Titanium Oxide 8 | 20 | 103 | 1.6 | 9.9 | 65 | B/35 wt % |
| Titanium Oxide 9 | 30 | 65 | 0.8 | 16.8 | 56 | C/5 wt % |
| Titanium Oxide 10 | 20 | 36 | 0.8 | 17.2 | 56 | C/10 wt % |
| Alumina 1 | 13 | 85 | 1.3 | 11.4 | 65 | D/10 wt % |
| Zirconia 1 | 28 | 76 | 1.5 | 12.5 | 63 | D/10 wt % |

In Table 3:

Treatment Agent A: dichloromethylsilane

Treatment Agent B: trimethoxyhexylsilane

Treatment Agent C: trimethoxyoctylsilane

Treatment Agent D: dimethylsilicone oil

Titanium Oxide 10 is titanium oxide obtained by a gas phase method process.

Present Invention Toners 1 through 11 as well as Comparative Toners 1 through 5 were obtained by adding hydrophobic titanium oxide in Table 3 as well as other additives to each of Colored Particles 1 through 7 in Table 1 while combining those as shown in Table 4.

TABLE 4

| Toner No. | Colored Particle No. | Type and Amount of Titanium Oxide | Type and Amount of Other Additives |
|---|---|---|---|
| Invention Toner 1 | Colored Particle 5 | Titanium Oxide 1/ 0.5 wt % | Silica A: 0.5 wt % |
| Invention Toner 2 | Colored Particle 5 | Titanium Oxide 2/ 0.8 wt % | none |
| Invention Toner 3 | Colored Particle 5 | Titanium Oxide 3/ 1.2 wt % | Silica A: 0.8 wt % |
| Invention Toner 4 | Colored Particle 5 | Titanium Oxide 4/ 0.8 wt % | Silica B: 0.8 wt % |
| Invention Toner 5 | Colored Particle 5 | Titanium Oxide 6/ 1.0 wt % | Silica B: 0.8 wt % |
| Invention Toner 6 | Colored Particle 5 | Titanium Oxide 7/ 1.0 wt % | none |
| Invention Toner 7 | Colored Particle 5 | Titanium Oxide 8/ 1.0 wt % | Silica A: 0.8 wt %/ Lubricant A: 0.05 wt % |
| Invention Toner 8 | Colored Particle 2 | Titanium Oxide 6/ 1.0 wt % | Silica B: 0.8 wt % |
| Invention Toner 9 | Colored Particle 3 | Titanium Oxide 6/ 1.0 wt % | Silica B: 0.8 wt % |
| Invention Toner 10 | Colored Particle 4 | Titanium Oxide 6/ 1.0 wt % | Silica B: 0.8 wt % |
| Invention Toner 11 | Colored Particle 6 | Titanium Oxide 6/ 1.0 wt % | Silica B: 0.8 wt % |
| Comparative Toner 1 | Colored Particle 5 | Titanium Oxide 5/ 1.0 wt % | Silica A: 0.8 wt % |
| Comparative Toner 2 | Colored Particle 5 | Titanium Oxide 9/ 1.0 wt % | Silica A: 0.8 wt % |
| Comparative Toner 3 | Colored Particle 5 | Titanium Oxide 10/ 1.0 wt % | Silica B: 0.5 wt % |
| Comparative Toner 4 | Colored Particle 1 | Titanium Oxide 6/ 1.0 wt % | Silica B: 0.8 wt % |
| Comparative Toner 5 | Colored Particle 7 | Titanium Oxide 6/ 1.0 wt % | Silica B: 0.8 wt % |

In Table 4:

Hydrophobic Silica A: having a number average primary particle diameter of 12 nm, and a degree of hydrophobicity of 56 percent Hydrophobic Silica B: having a number average primary particle diameter of 17 nm, and a degree of hydrophobicity of 60 percent lubricant: zinc stearate Present Invention Toners 12 through 26 as well as Comparative Toners 6 through 10 were obtained by adding fine inorganic particles as well as other additives in Table 3 to each of Colored Particles 8 through 14 in Table 2 while combining those as shown in Table 5. Further, fine inorganic particles as well as silica in Tables 4 and 5 were provided with hydrophobicity, and the amount added to colored particles is expressed in percent by weight.

TABLE 5

| Toner No. | Colored Particle No. | Type and Amount of Inorganic Particle | Type and Amount of Other Additives |
|---|---|---|---|
| Invention Toner 12 | Colored Particle 12 | Titanium Oxide 1/ 0.5 wt % | Silica A: 0.5 wt % |
| Invention Toner 13 | Colored Particle 12 | Titanium Oxide 2/ 0.8 wt % | none |
| Invention Toner 14 | Colored Particle 12 | Titanium Oxide 3/ 1.2 wt % | Silica A: 0.8 wt % |
| Invention Toner 15 | Colored Particle 12 | Titanium Oxide 4/ 0.8 wt % | Silica B: 0.8 wt % |
| Invention Toner 16 | Colored Particle 12 | Titanium Oxide 6/ 1.0 wt % | Silica B: 0.8 wt % |
| Invention Toner 17 | Colored Particle 12 | Titanium Oxide 7/ 1.0 wt % | none |
| Invention Toner 18 | Colored Particle 12 | Titanium Oxide 8/ 1.0 wt % | Silica A: 0.8 wt %/ Lubricant A: 0.05 wt % |
| Invention Toner 19 | Colored Particle 9 | Titanium Oxide 6/ 1.0 wt % | Silica B: 0.8 wt % |
| Invention Toner 20 | Colored Particle 10 | Titanium Oxide 6/ 1.0 wt % | Silica B: 0.8 wt % |
| Invention Toner 21 | Colored Particle 11 | Titanium Oxide 6/ 1.0 wt % | Silica B: 0.8 wt % |
| Invention Toner 22 | Colored Particle 13 | Titanium Oxide 6/ 1.0 wt % | Silica B: 0.8 wt % |
| Invention Toner 23 | Colored Particle 5 | Alumina 1/1.0 wt % | Silica A: 0.5 wt % |
| Invention Toner 24 | Colored Particle 5 | Zirconia 1/ 1.0 wt % | Silica A: 0.5 wt % |
| Invention Toner 25 | Colored Particle 12 | Alumina 1/1.0 wt % | Silica A: 0.5 wt % |
| Invention Toner 26 | Colored Particle 12 | Zirconia 1/ 1.0 wt % | Silica A: 0.5 wt % |
| Comparative Toner 6 | Colored Particle 12 | Titanium Oxide 5/ 1.0 wt % | Silica A: 0.8 wt % |
| Comparative Toner 7 | Colored Particle 12 | Titanium Oxide 9/ 1.0 wt % | Silica A: 0.8 wt % |
| Comparative Toner 8 | Colored Particle 12 | Titanium Oxide 10/ 1.0 wt % | Silica B: 0.5 wt % |
| Comparative Toner 9 | Colored Particle 8 | Titanium Oxide 6/ 1.0 wt % | Silica B: 0.8 wt % |
| Comparative Toner 10 | Colored Particle 14 | Titanium Oxide 6/ 1.0 wt % | Silica B: 0.8 wt % |

In Table 5:

Hydrophobic Silica A: having a number average primary particle diameter of 12 nm, and a degree of hydrophobicity of 56 percent Hydrophobic Silica B: having a number average primary particle diameter of 17 nm, and a degree of hydrophobicity of 60 percent Lubricant: zinc stearate Evaluation Double component developer materials (Present Invention Developer Materials 1 through 11 and Comparative Developer Materials 1 through 5), shown in Tables 6 and 7, were prepared by blending 95 parts of a silicone carrier with 5 parts of each of Present Invention Toners 1 through 11 and Comparative Toners 1 through 5.

Each of these developer materials was placed in an electronic copier "Konica 7050" (manufactured by Konica Corp.), and practical intermittent copying test was carried out until the 200,000th copy, employing a text image original having a pixel ratio of 2 percent at high temperature and high humidity ambient conditions (HH ambient conditions) of room temperature of 30° C. and relative humidity of 80 percent, and ambient conditions (LL ambient conditions) of room temperature of 10° C. and relative humidity of 20 percent. The density as well as the background stain of the first and the 200,000th copy images was measured. Tables 6 and 7 show the results. Further, said 7050 was equipped with a recycling mechanism which returned toner recovered in the cleaning section to the development unit.

Image density as well as background stain density was measured by a Mcbeth RD-918. The image density is expressed in absolute reflection density, while the background stain density is expressed in relative reflection density, when the density of the employed sheet of paper is "0".

Further, after completion of 200,000 copies at ambient conditions of high temperature and high humidity as well as low temperature and low humidity, generation copies were evaluated. The number of generations was counted according to the standard whether an image having 5 lines/mm is identified or not.

TABLE 6

| (Double component based) | | High Temperature and High Humidity Ambient Conditions | | | | |
|---|---|---|---|---|---|---|
| | | Image Density | | Density of Background Stain | | |
| Developer Material No. | Toner No. | Initial Copy | 200,000th Copy | Initial Copy | 200,000th Copy | Generation Copy |
| Invention Developer Material 1 | Invention Toner 1 | 1.42 | 1.39 | 0.001 | 0.005 | accepted until the 5th generation |
| Invention Developer Material 2 | Invention Toner 2 | 1.41 | 1.38 | 0.003 | 0.004 | accepted until the 5th generation |
| Invention Developer Material 3 | Invention Toner 3 | 1.42 | 1.39 | 0.002 | 0.006 | accepted until the 5th generation |
| Invention Developer Material 4 | Invention Toner 4 | 1.41 | 1.36 | 0.004 | 0.004 | accepted until the 5th generation |

TABLE 6-continued

| (Double component based) | | High Temperature and High Humidity Ambient Conditions | | | | |
|---|---|---|---|---|---|---|
| | | Image Density | | Density of Background Stain | | |
| Developer Material No. | Toner No. | Initial Copy | 200,000th Copy | Initial Copy | 200,000th Copy | Generation Copy |
| Invention Developer Material 5 | Invention Toner 5 | 1.41 | 1.39 | 0.003 | 0.003 | accepted until the 5th generation |
| Invention Developer Material 6 | Invention Toner 6 | 1.41 | 1.38 | 0.002 | 0.003 | accepted until the 5th generation |
| Invention Developer Material 7 | Invention Toner 7 | 1.41 | 1.38 | 0.004 | 0.003 | accepted until the 5th generation |
| Invention Developer Material 8 | Invention Toner 8 | 1.41 | 1.37 | 0.004 | 0.008 | accepted until the 5th generation |
| Invention Developer Material 9 | Invention Toner 9 | 1.42 | 1.35 | 0.002 | 0.007 | accepted until the 5th generation |
| Invention Developer Material 10 | Invention Toner 10 | 1.41 | 1.36 | 0.003 | 0.006 | accepted until the 5th generation |
| Invention Developer Material 11 | Invention Toner 11 | 1.42 | 1.38 | 0.001 | 0.004 | accepted until the 5th generation |
| Comparative Developer Material 1 | Comparative Toner 1 | 1.41 | 1.37 | 0.002 | 0.008 | accepted until the 3rd generation |
| Comparative Developer Material 2 | Comparative Toner 2 | 1.41 | 1.32 | 0.003 | 0.009 | accepted until the 3rd generation |
| Comparative Developer Material 3 | Comparative Toner 3 | 1.41 | 1.40 | 0.023 | 0.052 | accepted until the 2nd generation |
| Comparative Developer Material 4 | Comparative Toner 4 | 1.41 | 1.38 | 0.012 | 0.040 | accepted until the 2nd generation |
| Comparative Developer Material 5 | Comparative Toner 5 | 1.41 | 1.36 | 0.004 | 0.008 | accepted until the 2nd generation |

In Table 6, Comparative Toner 1 resulted in cleaning problems at the 150,000th copy, and streak-like image problems were generated on images.

TABLE 7

| (Double component based) | | Low Temperature and Low Humidity Ambient Conditions | | | | |
|---|---|---|---|---|---|---|
| | | Image Density | | Density of Background Stain | | |
| Developer Material No. | Toner No. | Initial Copy | 200,000th Copy | Initial Copy | 200,000th Copy | Generation Copy |
| Invention Developer Material 1 | Invention Toner 1 | 1.41 | 1.38 | 0.001 | 0.005 | accepted until the 5th generation |
| Invention Developer Material 2 | Invention Toner 2 | 1.41 | 1.36 | 0.002 | 0.003 | accepted until the 5th generation |
| Invention Developer Material 3 | Invention Toner 3 | 1.42 | 1.37 | 0.003 | 0.004 | accepted until the 5th generation |
| Invention Developer Material 4 | Invention Toner 4 | 1.41 | 1.38 | 0.002 | 0.003 | accepted until the 5th generation |
| Invention Developer Material 5 | Invention Toner 5 | 1.41 | 1.38 | 0.004 | 0.004 | accepted until the 5th generation |
| Invention Developer Material 6 | Invention Toner 6 | 1.41 | 1.35 | 0.002 | 0.003 | accepted until the 5th generation |
| Invention Developer Material 7 | Invention Toner 7 | 1.41 | 1.36 | 0.002 | 0.003 | accepted until the 5th generation |
| Invention Developer Material 8 | Invention Toner 8 | 1.41 | 1.38 | 0.001 | 0.007 | accepted until the 5th generation |
| Invention Developer Material 9 | Invention Toner 9 | 1.42 | 1.38 | 0.003 | 0.006 | accepted until the 5th generation |
| Invention Developer Material 10 | Invention Toner 10 | 1.41 | 1.37 | 0.004 | 0.008 | accepted until the 5th generation |
| Invention Developer Material 11 | Invention Toner 11 | 1.42 | 1.35 | 0.001 | 0.004 | accepted until the 5th generation |
| Comparative Developer Material 1 | Comparative Toner 1 | 1.41 | 1.35 | 0.002 | 0.008 | accepted until the 3rd generation |
| Comparative Developer Material 2 | Comparative Toner 2 | 1.24 | 1.19 | 0.000 | 0.001 | accepted until the 2nd generation |
| Comparative Developer Material 3 | Comparative Toner 3 | 1.41 | 1.38 | 0.003 | 0.006 | accepted until the 4th generation |
| Comparative Developer Material 4 | Comparative Toner 4 | 1.41 | 1.36 | 0.002 | 0.007 | accepted until the 3rd generation |
| Comparative Developer Material 5 | Comparative Toner 5 | 1.41 | 1.35 | 0.001 | 0.008 | accepted until the 2nd generation |

In Table 7, Comparative Toners 1 and 4 resulted in cleaning problems at the 150,000th copy, and streak-like image problems were generated on images.

Subsequently, Present Invention Toners 12 through 22, as well as Comparative Toners 6 through 10 were employed as single component based magnetic developer materials (Present Invention Developer Material 12 through 22 and Comparative Developer Material 6 through 10). Evaluzation was carried out in the same manner as for the aforementioned double component developer material, employing a modified digital copier "Konica 7033" manufactured by Konica Corp., under the development conditions described below. Tables 8 and 9 show the results. In the same manner as in the case of the double component developer materials, the toner recovered in the cleaning section was returned to the development unit and thus a recycling method was utilized.

(Charging Conditions of Photoreceptor)

Charging unit: scorotron charging unit

Charge potential (initial charge potential): 720 V (Development Conditions)

DC bias: −500V

AC bias: $V_{pp}$=1,800 V, frequency=20 kHz $D_{sd}$ (distance between the photoreceptor and the development sleeve): 600 μm Regulation of developer material layer: magnetic H-Cut system Thickness of developer material layer: 300 μm Diameter of development sleeve: 40 mmϕ. The surface of the development sleeve is covered with a phenol resin in which electrically conductive carbon black is dispersed.

TABLE 8

| (Single component based) | | High Temperature and High Humidity Ambient Conditions | | | | |
|---|---|---|---|---|---|---|
| | | Image Density | | Density of Background Stain | | |
| Developer Material No. | Toner No. | Initial Copy | 200,000th Copy | Initial Copy | 200,000th Copy | Generation Copy |
| Invention Developer Material 12 | Invention Toner 12 | 1.44 | 1.39 | 0.002 | 0.007 | accepted until the 5th generation |
| Invention Developer Material 13 | Invention Toner 13 | 1.45 | 1.39 | 0.003 | 0.005 | accepted until the 5th generation |
| Invention Developer Material 14 | Invention Toner 14 | 1.45 | 1.39 | 0.003 | 0.007 | accepted until the 5th generation |
| Invention Developer Material 15 | Invention Toner 15 | 1.44 | 1.37 | 0.005 | 0.005 | accepted until the 5th generation |
| Invention Developer Material 16 | Invention Toner 16 | 1.44 | 1.39 | 0.002 | 0.004 | accepted until the 5th generation |
| Invention Developer Material 17 | Invention Toner 17 | 1.44 | 1.38 | 0.003 | 0.004 | accepted until the 5th generation |
| Invention Developer Material 18 | Invention Toner 18 | 1.44 | 1.38 | 0.004 | 0.003 | accepted until the 5th generation |
| Invention Developer | Invention Toner 19 | 1.43 | 1.36 | 0.005 | 0.009 | accepted until the |

TABLE 8-continued

| (Single component based) | | High Temperature and High Humidity Ambient Conditions | | | | |
|---|---|---|---|---|---|---|
| | | Image Density | | Density of Background Stain | | |
| Developer Material No. | Toner No. | Initial Copy | 200,000th Copy | Initial Copy | 200,000th Copy | Generation Copy |
| Material 19 | | | | | | 5th generation |
| Invention Developer Material 20 | Invention Toner 20 | 1.45 | 1.38 | 0.002 | 0.008 | accepted until the 5th generation |
| Invention Developer Material 21 | Invention Toner 21 | 1.45 | 1.35 | 0.005 | 0.007 | accepted until the 5th generation |
| Invention Developer Material 22 | Invention Toner 22 | 1.43 | 1.39 | 0.004 | 0.005 | accepted until the 4th generation |
| Invention Developer Material 23 | Invention Toner 23 | 1.42 | 1.39 | 0.001 | 0.005 | accepted until the 5th generation |
| Invention Developer Material 24 | Invention Toner 24 | 1.41 | 1.37 | 0.001 | 0.006 | accepted until the 5th generation |
| Invention Developer Material 25 | Invention Toner 25 | 1.44 | 1.38 | 0.001 | 0.007 | accepted until the 5th generation |
| Invention Developer Material 26 | Invention Toner 26 | 1.44 | 1.38 | 0.001 | 0.007 | accepted until the 5th generation |
| Comparative Developer Material 11 | Comparative Toner 6 | 1.45 | 1.37 | 0.005 | 0.010 | accepted until the 3rd generation |
| Comparative Developer Material 12 | Comparative Toner 7 | 1.44 | 1.36 | 0.003 | 0.008 | accepted until the 3rd generation |
| Comparative Developer Material 13 | Comparative Toner 8 | 1.43 | 1.38 | 0.027 | 0.058 | accepted until the 2nd generation |
| Comparative Developer Material 14 | Comparative Toner 9 | 1.42 | 1.39 | 0.019 | 0.047 | accepted until the 2nd generation |
| Comparative Developer Material 15 | Comparative Toner 10 | 1.44 | 1.36 | 0.003 | 0.009 | accepted until the 2nd generation |

In Table 8, Comparative Toners 6 and 9 resulted in cleaning problems at the 122,000th copy, and streak-like image problems were generated on images.

TABLE 8

| (Single component based) | | Low Temperature and Low Humidity Ambient Conditions | | | | |
|---|---|---|---|---|---|---|
| | | Image Density | | Density of Background Stain | | |
| Developer Material No. | Toner No. | Initial Copy | 200,000th Copy | Initial Copy | 200,000th Copy | Generation Copy |
| Invention Developer Material 12 | Invention Toner 12 | 1.43 | 1.39 | 0.003 | 0.005 | accepted until the 5th generation |
| Invention Developer Material 13 | Invention Toner 13 | 1.45 | 1.38 | 0.002 | 0.003 | accepted until the 5th generation |
| Invention Developer Material 14 | Invention Toner 14 | 1.44 | 1.39 | 0.005 | 0.006 | accepted until the 5th generation |
| Invention Developer Material 15 | Invention Toner 15 | 1.43 | 1.37 | 0.004 | 0.005 | accepted until the 5th generation |
| Invention Developer Material 16 | Invention Toner 16 | 1.43 | 1.39 | 0.002 | 0.004 | accepted until the 5th generation |
| Invention Developer Material 17 | Invention Toner 17 | 1.44 | 1.39 | 0.003 | 0.003 | accepted until the 5th generation |
| Invention Developer Material 18 | Invention Toner 18 | 1.45 | 1.39 | 0.005 | 0.004 | accepted until the 5th generation |
| Invention Developer Material 19 | Invention Toner 19 | 1.43 | 1.38 | 0.003 | 0.005 | accepted until the 5th generation |
| Invention Developer Material 20 | Invention Toner 20 | 1.44 | 1.36 | 0.005 | 0.008 | accepted until the 5th generation |
| Invention Developer Material 21 | Invention Toner 21 | 1.44 | 1.39 | 0.002 | 0.007 | accepted until the 5th generation |
| Invention Developer Material 22 | Invention Toner 22 | 1.43 | 1.38 | 0.004 | 0.005 | accepted until the 4th generation |
| Invention Developer Material 23 | Invention Toner 23 | 1.40 | 1.38 | 0.001 | 0.005 | accepted until the 5th generation |
| Invention Developer Material 24 | Invention Toner 24 | 1.40 | 1.36 | 0.001 | 0.005 | accepted until the 5th generation |
| Invention Developer Material 25 | Invention Toner 25 | 1.45 | 1.39 | 0.001 | 0.005 | accepted until the 5th generation |
| Invention Developer Material 26 | Invention Toner 26 | 1.45 | 1.39 | 0.001 | 0.005 | accepted until the 5th generation |
| Comparative Developer Material 11 | Comparative Toner 6 | 1.42 | 1.38 | 0.002 | 0.004 | accepted until the 3rd generation |
| Comparative Developer Material 12 | Comparative Toner 7 | 1.25 | 1.18 | 0.000 | 0.001 | accepted until the 2nd generation |

TABLE 8-continued

| (Single component based) | | Low Temperature and Low Humidity Ambient Conditions | | | | |
|---|---|---|---|---|---|---|
| | | Image Density | | Density of Background Stain | | |
| Developer Material No. | Toner No. | Initial Copy | 200,000th Copy | Initial Copy | 200,000th Copy | Generation Copy |
| Comparative Developer Material 13 | Comparative Toner 8 | 1.45 | 1.39 | 0.002 | 0.007 | accepted until the 4th generation |
| Comparative Developer Material 14 | Comparative Toner 9 | 1.42 | 1.37 | 0.003 | 0.006 | accepted until the 3rd generation |
| Comparative Developer Material 15 | Comparative Toner 10 | 1.43 | 1.38 | 0.002 | 0.005 | accepted until the 2nd generation |

In Table 9, Comparative Toners 6 and 9 resulted in cleaning problems at the 122,000th copy, and streak-like image problems were generated on images.

As can be seen in Tables 6 through 9, in Examples 1 through 22, under both of high temperature and high humidity (at HH ambient condition), and low temperature and low humidity (at LL ambient condition), during repeated image forming process reaching 200,000 copies employing the toner recycling system, a stable charge amount is maintained, and accordingly neither a decrease in density nor the formation of background stain occurs. On the other hand, in Comparative Examples 1 through 10 employing comparative toners, the charge amount varies greatly, and either a decrease in image density or background stain occurs. Spacifically, image quality of the 200,000th copy is degraded to exhibit minimal commercial viability.

As practically proven by examples, the toner and the image forming method of the present invention exhibit excellent effect insuch a manner that irrespective of ambient conditions, during repeated image forming process employing a toner recycling system, a stable charge amount is maintained, and accordingly, neither a decrease in image density nor formation of background stain occurs, and high quality images are consistently obtained.

What is claimed is:

1. An electrophotographic toner comprising colored particles comprised of at least resin and colorant, and hydrophobic inorganic particle, wherein the hydrophobic inorganic particle has a saturated moisture content $W_L$ at ambient conditions of 10° C. and 20 percent RH of 1.0 to 2.0 percent by weight, a BET value of 70 to 120 $m^2/g$, and a number average primary particle diameter of 10 to 50 nm, and volume average particle diameter of the electrophotographic toner is between 3.0 and 9.0 $\mu$m.

2. The electrophotographic toner of claim 1 wherein the hydrophobic inorganic particle has following relationship between saturated moisture content $W_H$ at ambient condition of 30° C. and 80 percent RH and saturated moisture content $W_L$ at ambient condition of 10° C. and 20 percent RH:

$$0 \leqq (W_H - W_L)/W_L \times 100 \leqq 15.0.$$

3. The electrophotographic toner of claim 1 wherein the hydrophobic inorganic particle contains element of Si, Al, Ti Zr or Ce.

4. The electrophotographic toner of claim 1 wherein the hydrophobic inorganic particle is hydrophobic titanium oxide.

5. The electrophotographic toner of claim 1 wherein the hydrophobic inorganic particle has wettability of at least 40.

6. The electrophotographic toner of claim 1 wherein the hydrophobic inorganic particle is covered with 5 to 40% by weight of hydrophobicity providing agent with reference to the hydrophobic inorganic particle.

7. The electrophotographic toner of claim 1 wherein content of the hydrophobic inorganic particle is 0.1 to 10 weight % to the colored particle.

8. The electrophotographic toner of claim 1 wherein the hydrophobic inorganic particle has degree of hydrophobicity of at least 40.

9. The electrophotographic toner of claim 1 wherein $W_L$ of the hydrophobic inorganic particle is 1.2 to 1.9 percent by weight.

10. The electrophotographic toner of claim 2 wherein $\{(W_H - W_L)/W_L\} \times 100$ is 7.0 to 15.0.

11.The electrophotographic toner of claim 2 wherein the hydrophobic inorganic particles contains element of Si, Al, Ti Zr or Ce.

12. The electrophotographic toner of claim 11 wherein content of the hydrophobic inorganic particle is 0.1 to 10 weight % to the colored particle.

13. The electrophotographic toner of claim 12 wherein the hydrophobic inorganic particle is hydrophobic titanium oxide.

14. The electrophotographic toner of claim 12 wherein $W_L$ of hydrophobic inorganic particle is 1.2 to 1.9 percent by weight and wherein $\{(W_H - W_L)/W_L\} \times 100$ is 7.0 to 15.0.

15. An electrophotographic developer comprising electrophotographic toner comprising colored particles comprised of at least resin and colorant, and hydrophobic inorganic particle, wherein the hydrophobic inorganic particle has a saturated moisture content $W_L$ at ambient conditions of 10° C. 20 percent RH of 1.0 to 2.0 percent by weight, a BET value of 70 to 120 $m^2/g$, and a number average primary particle diameter of 10 to 50 nm, and volume average particle diameter of the electrophotographic toner is between 3.0 and 9.0 $\mu$m.

16. The developer of claim 15, further comprising a resin coated carrier.

17. An image forming method comprising steps of exposing to form electrostatic latent image on a photoreceptor, developing said electrostatic latent image by a toner of claim 1.

* * * * *